United States Patent [19]

Krob

[11] 4,088,343

[45] May 9, 1978

[54] FRONT JAW

[75] Inventor: Erwin Krob, Vienna, Austria

[73] Assignee: TMC Corporation, Baar, Zug, Switzerland

[21] Appl. No.: 748,893

[22] Filed: Dec. 9, 1976

[30] Foreign Application Priority Data

Dec. 12, 1975 Austria ..... 9474/75

[51] Int. Cl.[2] ..... A63C 9/08

[52] U.S. Cl. ..... 280/625

[58] Field of Search ..... 280/625, 631

[56] References Cited

U.S. PATENT DOCUMENTS

| | | | |
|---|---|---|---|
| 3,743,308 | 7/1973 | Allsop | 280/625 |
| 3,854,741 | 12/1974 | Marker | 280/625 |
| 3,909,026 | 9/1975 | Salomon | 280/625 |
| 3,950,002 | 4/1976 | Schweizer | 280/625 |
| 4,025,087 | 5/1977 | Krob | 280/631 |

*Primary Examiner*—Robert R. Song
*Attorney, Agent, or Firm*—Blanchard, Flynn, Thiel, Boutell & Tanis

[57] ABSTRACT

A front jaw for a ski binding having a base plate fixedly secured to the ski and on which two pivot axes are positioned which are perpendicular with respect thereto. A two-arm lever is pivotally supported on each of the pivot axes and one arm thereof is adapted to move into and out of engagement with the toe of the ski boot. The other arm of each two-arm lever cooperates with a pull rod resiliently urged to the initial position by an adjustable spring operated mechanism to resiliently hold the toe of the ski boot in the clamped position on the ski. Each of the two-arm levers cooperates with an intermediate structure to effectively control the spring force urging the two-arm levers to the clamping position holding the ski boot onto the ski. In one embodiment, this intermediate structure is a plate resiliently held perpendicular to the longitudinal axis of the pull rod and is moved to a position out of perpendicular relationship against the spring force by a pivoting of one of the two-arm levers. Another embodiment includes a guide for effecting a movement of the plate while maintaining the perpendicular relationship with the axis of the pull rod. A still further embodiment utilizes control linkages and structure for adjusting the effective length of the control linkages to thereby control the resilient force urging the two-arm levers to the clamping position.

14 Claims, 7 Drawing Figures

FRONT JAW

FIELD OF THE INVENTION

The invention relates to a front jaw having a ski-fixed base plate on which two axes are provided and which are arranged perpendicularly with respect to said base plate and on each of which there is pivotally supported a two-arm lever, whereby the longer lever arms engage the ski boot, the shorter lever arms, however, are associated with a locking member which is guided movably in longitudinal direction of the ski against the force of a spring and whereby the locking member is constructed as a pull rod which has in the area of the end associated with the two-arm levers an annular groove or two hooks into which engage the shorter lever arms (or intermediate levers supported on said lever arms).

BACKGROUND OF THE INVENTION

Such a front jaw is described in Austrian Pat. No. 315,698. The basic purpose of this known construction was to produce a simple construction and space-saving design. This is clearly achieved by the known solution. A disadvantage of the known construction lies, however, in the spring force being dependent on the conditions of the engaging points of the lever arms on the jaw parts. Therefore, the purpose of the present invention is to produce a solution through which the spring force can be reduced.

The designated purpose is attained inventively by the two-arm levers engaging with their area facing the jaw a support plate which is loaded by the spring acting onto the locking member.

This measure permits the spring force to be reduced to approximately 70% of the actual value thereof. In extreme cases, the spring force may even be reduced to 50%, however, then a large width of the front jaw must be accepted.

A particularly preferred embodiment of the invention is seen in the support plate being supported by means of a guideway on a fixed part of the jaw, for example on the outer surface of the setscrew for adjusting the spring force. In this manner the spring force is reduced to a value of 50% without any excessive increase of the binding width. This value can still further be reduced, if according to a further characteristic of the invention, the surface on which the support plate is supported is made of a material having particularly favorable friction characteristics. In this case, the jaw is independent of dirt and pure spring forces can be used for calculating the release force.

The invention also relates to a front jaw having a ski-fixed base plate on which two pivot axes are arranged perpendicularly with respect to the base plate, each pivot axis having pivotally supported thereon a two-arm lever, whereby the longer lever arms engage the ski boot, the shorter ones, however, being associated with a locking member which is movably guided in the longitudinal direction of the ski against the force of a spring. The locking member is constructed as a pull rod which has in the area of the end which faces the two-arm levers an annular groove or two hooks into which engage the shorter lever arms (or intermediate levers supported on said lever arms). Each two-arm lever has at its common area, which does not face the associated pivot axis, an anchor member having a control linkage which is connected or can be connected through its other end to a support frame. The support frame is guided parallel to the pull rod on a fixed part of the jaw, for example on the outer surface of the setscrew for adjusting the spring force. In this manner, the spring force can be reduced as desired, so that a limit is determined only by economical consideration. One can rely for a practical use on spring forces of approximately 10% to 20%.

In a further development of this inventive thought it is possible to releasably connect the control linkage with the support for example through a holding bracket on the support frame, whereby the individual holding brackets have holes therein for receiving connecting pins, bolts, screws or the like to couple the free ends of the control linkages to the brackets.

BRIEF DESCRIPTION OF THE DRAWINGS

Further advantages and details of the invention will now be discussed more in detail in connection with the drawings, which show several exemplary embodiments. In the drawings.

DETAILED DESCRIPTION

Figure 1:
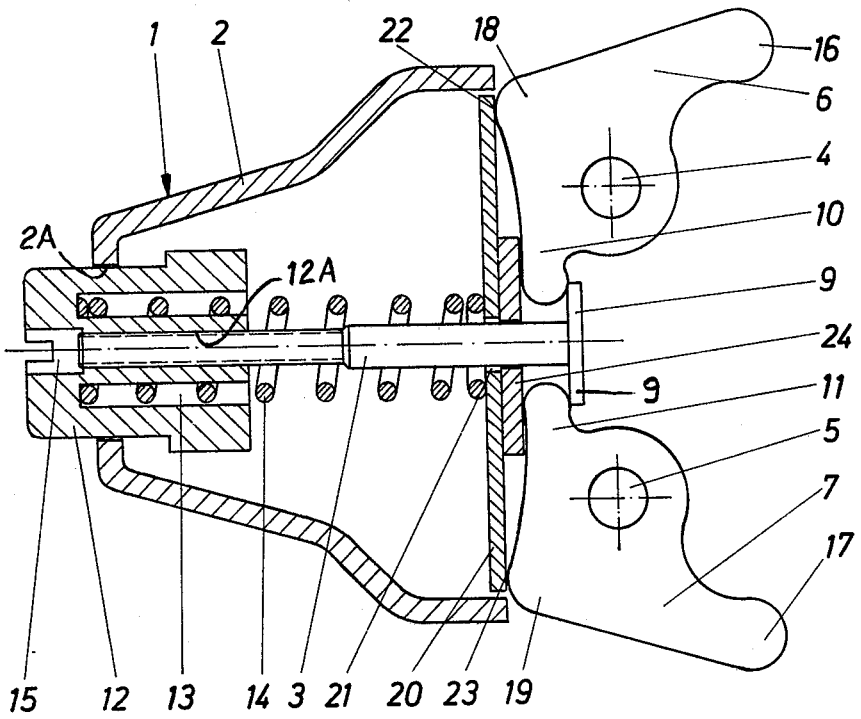
FIGS. 1 and 2 illustrate a first exemplary embodiment of the invention in a closed and partly opened, respectively, position.

Corresponding parts in the various embodiments will be identified with the same reference numerals in the following description. Differently constructed parts which perform the same or similar function will be identified with the same reference numeral as the previously discussed structure but with the prime (') suffix added thereto.

Figure 2:
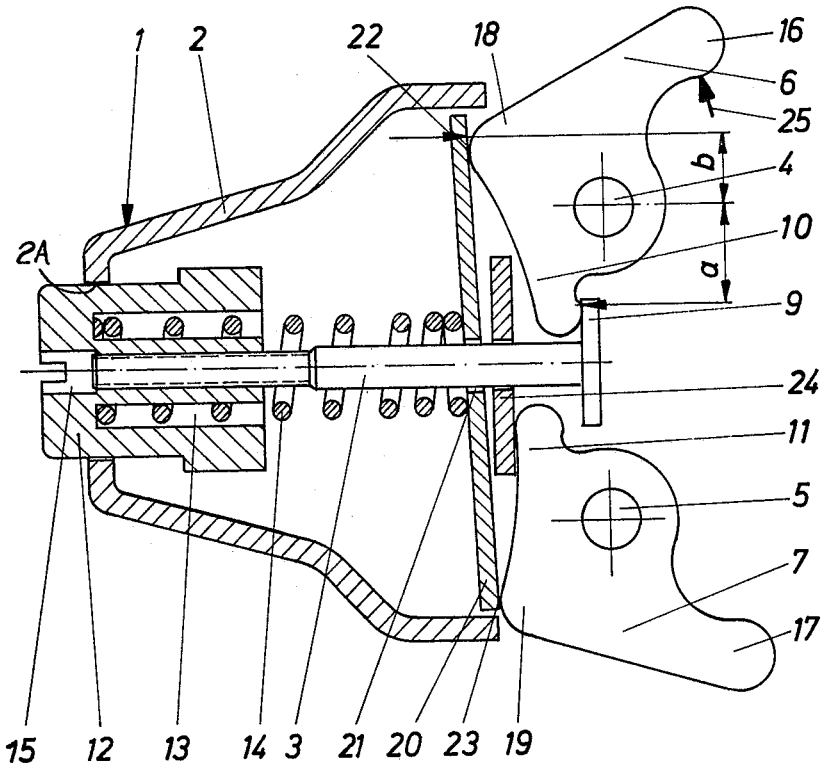

As can be taken from the first exemplary embodiment which is illustrated in FIGS. 1 and 2, the front jaw, which as a whole is identified by reference numeral 1, has a housing 2 and pivot pins defining pivot axes 4 and 5 mounted on a not illustrated base plate fixed to the ski, which pivot axes are arranged perpendicularly with respect to the horizontal plane of the base plate. Two-arm levers 6 and 7 are pivotally mounted on the pivot axes 4 and 5 and engage and cooperate with a reciprocal pull rod 3 which serves as a locking member. The pull rod 3 is reciprocal in a direction parallel to the axis of the ski and in the longitudinal direction of the front jaw 1 relative thereto. The rod 3 lies substantially on the central axis of the front jaw 1. The pull rod 3 has on its free end, which is associated with the two-arm levers 6 and 7, two hook-like members 9 which cooperate with the shorter lever arms 10 and 11 of the two-arm levers 6 and 7. The other end of the pull rod 3 is threadedly engaged as at 12A with a sleeve 12. The sleeve 12 is slidably mounted in an opening 2A in the housing 2 of the front jaw 1. It has an annular recess 13 in which one end of a spring 14 which loads the pull rod 3 is received. The other end of the spring 14 engages a movable support plate 20 which loosely encircles the rod 3 and the spring force holds the movable plate in engagement with a part 24 of the housing 2 and the plane thereof is perpendicular to the axis of the rod 3. The effective distance between the sleeve 12 and the hooks 9 on the pull rod 3 can be adjusted by means of a screw driver received in the slotted recess 15. As a result, the spring force which is applied on the two-arm levers 6 and 7 is adjusted. The longer lever arms 16 and 17 engage the not illustrated ski boot, particularly the toe of the ski boot.

The two-arm levers 6 and 7 engage adjacent their areas 18 and 19 which are remote from the pivot axes 4, 5 and also the toe of the ski boot a support plate 20. The areas or zones of engagement 22 and 23 on the support plate 20 with the two-arm levers are listed separately for a better understanding. The support plate 20 has in its center area an opening 21 which is oblong in transverse direction. This assures that the support plate 20 is movable in relationship to the pull rod 3 transversely with respect to the longitudinal direction of the front jaw 1 without jamming, as this is discussed in more detail in connection with FIG. 2. When the ski boot is clamped in the ski binding, that is the clamped condition, the shorter lever arms 10 and 11 of the two-arm levers 6 and 7 lie between the two hooks 9 and the part 24 of the front jaw 1 fixed to the base plate.

If now a force is applied to one of the two-arm levers, here for example to the lever 6, which force is indicated by the arrow 25 and the force is larger than the loading force of the spring 14, the support plate 20 is pivoted against the force of the spring 14 about a pivot point intersecting the rod 3. The actual pivot point is determined, according to FIG. 2, by the actual location of the engagement point between the portion 19 on the rocking lever 7 and the zone 23 on the support plate 20 so that the shorter lever arm 11 of the unpivoted lever 7 is supported on the part 24. Since on the one hand the pivoted two-arm lever 6 applies through the associated hook 9 and on the other hand through the support plate 20 a force onto the spring 14, the force which is applied by the spring 14 onto the two-arm lever 6, is approximately 70% of the force which would be applied by one spring according to the known structures. It can easily be seen that this force depends on the conditions or positions of the lever arms which must here be considered and the distances between the support points of the shorter lever arm on the hook or between the support plate and the pivot axis. These distances are identified in FIG. 1 as the moment arms *a* and *b*. The following equation can be stated as follows:

$$M_{hold} = F \cdot a + (F/2) \cdot b)$$

wherein $M_{hold}$ equals the torque or turning moment of the force $F$ acting on one of the lever arms 16 or 17 wherein F is the force represented by the arrow 25 in FIG. 2 caused by the ski boot on one of the lever arms 16 or 17 since only half of the spring force acts onto one of the two-arm levers. The spring force amounts thus approximately to 70% of the actual spring force and can be reduced to 50%, if *b* equals 2*a*. In this case, however, the front jaw would be too wide.

Figure 3:
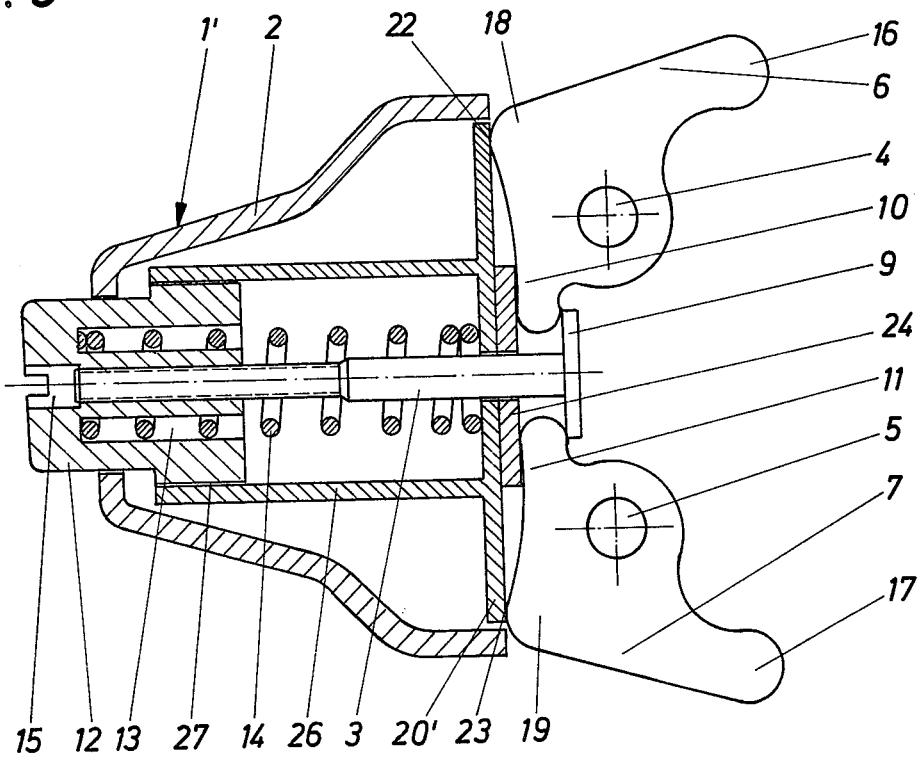
FIGS. 3 and 4 illustrate a second exemplary embodiment of the invention, also in a closed and opened, respectively, position.
Figure 4:
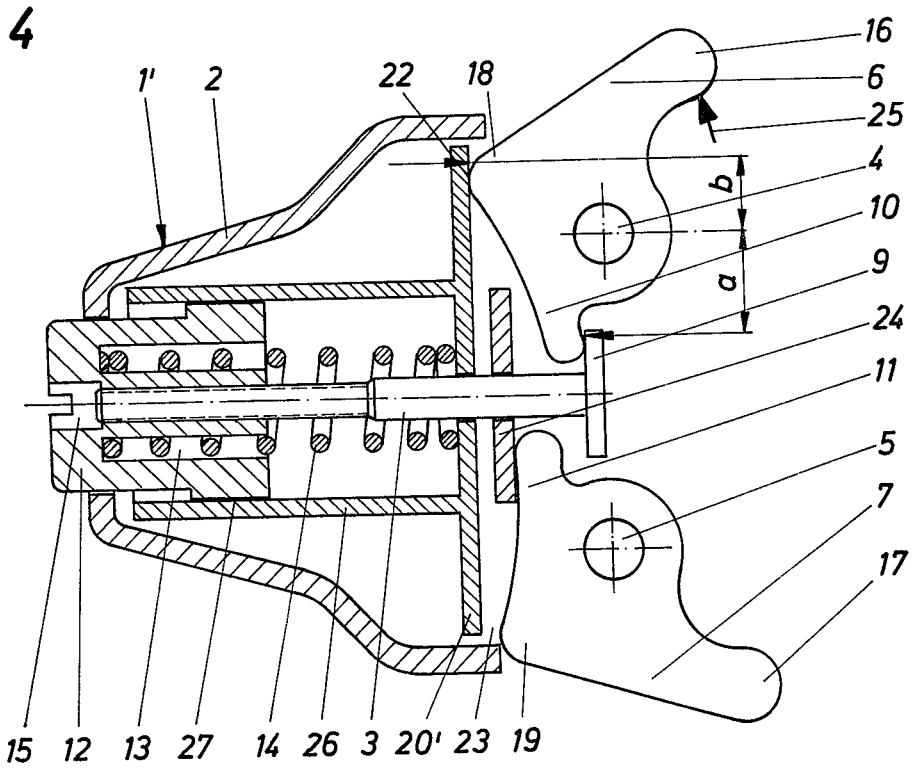

In the second exemplary embodiment according to FIGS. 3 and 4, the movable support plate 20′ has a hollow guideway 26 mounted thereon and extending forwardly from the pivotal levers 6 and 7. The hollow guideway 26 snugly and slidingly encircles the outer surface 27 of the sleeve 12. The guideway 26 can be designed as a parallel guideway if the outer surface 27 of the sleeve 12 is designed accordingly. The guideway 26 will, however, preferably have a cylinder shape. The surface of the sleeve 12 can, if desired, have a not illustrated low friction material thereon or it can be coated or covered with a low friction material. The front jaw becomes in this manner unsuseptible as much as possible of contamination from dirt so that the pure spring force can be used as a calculation basis. This construction will be used particularly for an elongated arrangement of the front jaw 1′. In this case the equation becomes:

$$M_{hold} = F \cdot a + (F \cdot b)$$

If *a* equals *b*, a spring force acting on the levers 6 and 7 can be expected which at a maximum amounts to 50% of the actual value of the spring force.

However, it is not always advantageous to reduce the friction between the guideway 26 and outer surface of the sleeve. Rather it may often be of an advantage to intentionally increase the friction so that the spring force which is to be applied to the levers 6 and 7 can be additionally reduced. This calculated increase in friction can by no means be compared or confused with an undesired frictional increase caused by dirt and the like because in the latter case this consideration lies outside of the control of the designer. To increase the friction, roughened surfaces or surfaces having notches therein can be used. The spring forces which are thereby used will have to be calculated from case to case by the man skilled in the art in view of the existing friction.

Figure 5:
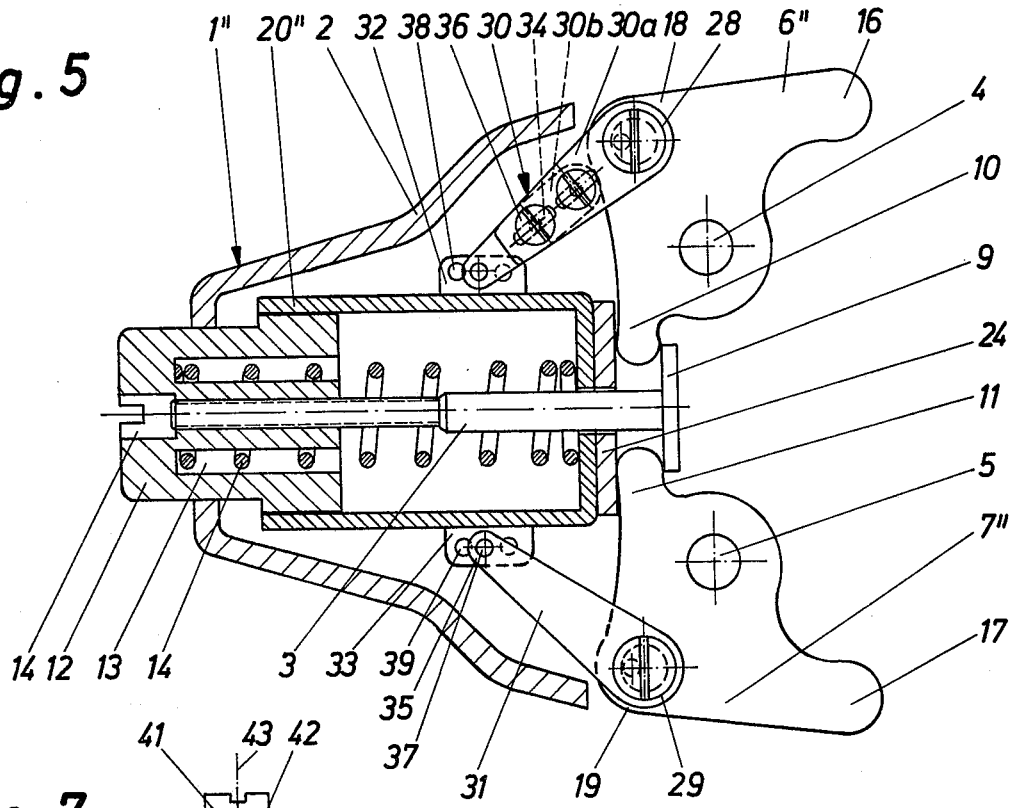
FIGS. 5 and 6 illustrate two further exemplary embodiments, wherein in the lower half of each figure a one-part control linkage is illustrated and in the upper halves a two-part control linkage is illustrated, both halves being illustrated in the closed and in the opened position, respectively.
Figure 7:
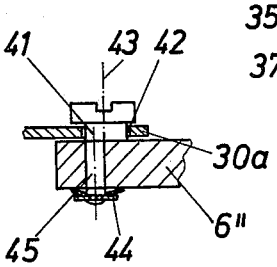
FIG. 7 is a cross-sectional view taken along the line VII—VII of FIG. 6.
Figure 6:
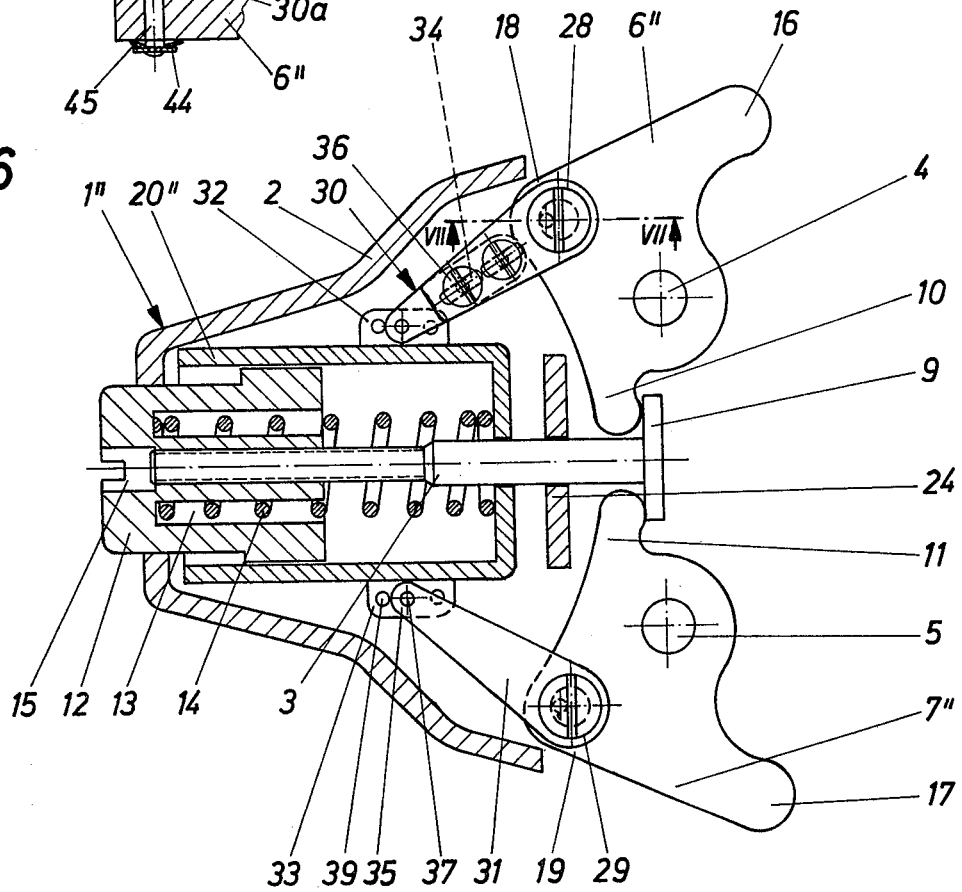

A further example is illustrated in FIGS. 5 to 7. In the front jaw 1″, the two-arm levers 6″ and 7″ have in their corner areas 18 and 19 additional anchor members 28 and 29 which can be connected through control linkage members 30 and 31 to brackets 32 and 33 secured to the movable support plate 20″. In this embodiment, the movable support plate 20″ is not a plate but is, instead, a hollow guideway member or frame similar in construction to the guideway 26. As a comparison of the upper and lower halves of FIGS. 5 and 6 illustrates, two embodiments for control linkage members 30 and 31 are presented and are differently designed. With respect to the control linkage 31, it is only to be said that it is connected at its free end 35 by means of a pin, a bolt 37 or the like to one of the holes 39 provided in the holding bracket 33 mounted on the support plate 20″. A screw can also be utilized as a connecting element.

In the exemplary embodiment according to the upper half of the control linkage 30 in the drawing, said control linkage is constructed in two parts. The two parts 30*a* and 30*b* are overlapped relative to one another and are secured to each other along slotted holes 34 by means of screws 36 which can be inserted into the slotted holes. The securement to the holding bracket 32 is similar to that which was described earlier with respect to the control linkage 31. Holes 38 are for this purpose provided in the holding bracket 32.

FIG. 7 illustrates additionally a cross-section of FIG. 6 for a better understanding of the anchor member 28. From FIG. 7 one will note the two-arm lever 6″ and the control linkage part 30*a* lying above the two-arm lever 6″ and held together by means of an eccentrically shaped member 41. The eccentric 41 of the anchor member 28 includes a bolt part 45 which freely extends through the two-arm lever 6″ and the lower end thereof has a locking device 44 thereon to prevent removal of the bolt. The eccentric 41 is received in a hole 42 of the control linkage part 30*a* and has on its upper end surface a slot 43 for receiving a suitable tool, for example a screw driver. It can easily be understood that the relative position between the control linkage 30 and the two-arm lever 6″ can be determined by an adjustment of the position of the eccentric 41. Depending on the position of the eccentric 41, the control linkage 30 can be "pulled in" or the two-arm lever 6″ be "swung outwardly", whereby both movements refer to the engaged position (namely to the clamped condition of the ski boot). In this manner, it is possible to adjust the front jaw 1″ to differently constructed ski boots or to different boot widths.

In this case, the force relationships are such that the spring force could be reduced theoretically to a 0-value. Economical considerations will, however, place a sensible limit to this desire; in real life one will limit oneself to a spring force of approximately 10 to 20%.

The invention is not limited to the listed exemplary embodiments. A number of variations exist without departing from the scope of protection. For example, it is possible to partly vary the described embodiments among one another to cause the spring force which must be produced to also receive a suitable change. It is also possible to differently design the support surface or the guideway. A frame or a cylinder does not necessarily need to be utilized. Also constructions are sufficient which are known for example from piston guides. Also the construction of the control linkages may take on a different design; also the connection of a control linkage and a holding bracket may be a differently jointed connection. It is also possible to use a locking recepticle which is partly closed and in which a ball head is positioned and which cooperates with a rod or a control linkage of the aforedescribed type. It is also conceivable to design the adjustment mechanism as a toothed rack whereby then the securement takes place not between control linkage and the holding bracket but along the toothed rack.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A front jaw of a safety ski binding for use on a ski, comprising:

housing means;

a pair of two-arm levers pivotally secured to said housing means about respective vertical axes, each arm of said pair of two-arm levers being located on opposite sides of the longitudinal center line of said housing means and pivotal between first and second positions;

an elongated rod mounted for reciprocal movement on said housing means and parallel to the longitudinal axis of said ski, said rod having means thereon cooperatively engaged with one of the arms of each of said two-arm levers;

spring means for normally urging said rod in one direction to effect a normal urging of each of said two-arm levers toward said first position, said spring means resiliently yielding to pivotal movement of at least one of said two-arm levers toward said second position; and means including a portion of each of said two-arm levers for applying an additional force to said spring means in response to said pivotal movement of said one two-arm lever toward said second position to increase the magnitude of the force causing the resilient yielding to said spring means.

2. A front jaw binding according to claim 1, wherein said spring means includes a compression spring and an adjustable sleeve adjustably connected to said rod;

wherein said housing means includes stop means for limiting the pivotal movement of said two-arm levers at said first position;

wherein said means for applying an additional force to said spring includes a movable support plate urged into engagement with said stop means by said spring extending between said adjustable sleeve and said movable support plate, a portion of each of said two-arm levers adjacent said pivotal support therefor engaging said movable support plate whereby a pivotal movement of at least one of said two-arm levers will effect a compression of said spring means and a displacement of said movable support plate in response to said engagement by said portion of said one two-arm lever will effect a further compression of said spring.

3. A front jaw binding according to claim 2, wherein said adjustable sleeve is slidably mounted on said housing means.

4. A front jaw binding according to claim 2, wherein said one arm of said two-arm levers are each pivotally supported on and engage one side of said stop means; and wherein said movable support plate engages said stop means on a side remote from said two-arm levers.

5. A front jaw binding according to claim 1, wherein the longitudinal axis of said elongated rod is perpendicular to the plate containing the pivot axes for said two-arm levers.

6. A safety ski binding for use on a ski, comprising:

housing means;

a pair of two-arm levers pivotally secured to said housing means about respective vertical axes, each arm of said pair of two-arm levers being located on opposite sides of the longitudinal center line of said housing means and pivotal between first and second positions;

stop means fixedly related to said housing means for limiting the pivotal movement of said two-arm levers at said first position;

resilient means for biasing said two-arm levers toward said first position and into engagement with said stop means, said resilient means including a spring, means defining an elongated rod mounted for reciprocal movement on said housing means and parallel to the longitudinal axis of said ski, said rod having means thereon cooperatively engaged with one of the arms of each of said two arm levers, a movable support plate and an adjustable sleeve adjustably connected to said elongated rod, said spring engaging and extending between said adjustable sleeve and said support plate and normally urging said movable support plate into engagement with said stop means and simultaneously normally urging said adjustable sleeve away from said stop means to hold said means on said rod in said cooperative engagement with said one arm of said two-arm levers, a portion of each of said two-arm levers adjacent said pivotal support therefor and spaced from said means on said rod engaging said movable support plate whereby a pivotal movement of at least one of said two arm levers will effect a compression of said spring and a displacement of said movable support plate in response to said engagement by said portion of said one two-arm lever to effect a further compression of said spring.

7. A front jaw binding according to claim 6, wherein said adjustable sleeve is movable in a direction parallel to said rod and relative to said housing means; and wherein said movable support plate has guideway means thereon cooperatively slidingly supported on the outer surface of said adjustable sleeve.

8. A front jaw binding according to claim 7, wherein the guideway means is constructed as a cylinder.

9. A front jaw binding according to claim 7, wherein the surface of said adjustable sleeve consists of a material having excellent sliding characteristics by having at least a portion thereof made of a low friction coefficient material.

10. A front jaw binding according to claim 9, wherein said surface has grooves, ribs or the like to facilitate the sliding connection between said guideway means and said surface.

11. A front jaw binding according to claim 6, wherein each two-arm lever has at its area which does not face the associated pivot axis an anchor member with a control linkage connected thereto and extending to and being connected to said movable support plate, said support plate being guided parallel to said elongated rod on the outer surface of said adjustable sleeve.

12. A front jaw binding according to claim 11, wherein said control linkages are releasably connected to said support plate through at least one holding bracket having holes therein for receiving connecting pins means which effect a connection of the free ends of said control linkages to said support frame.

13. A front jaw binding according to claim 11, wherein the individual control linkages are constructed in two relatively movable parts.

14. A front jaw binding according to claim 11, wherein each anchor member has associated with it one eccentrically shaped member which cooperates with a bore in an associated control linkage and assures an adjustment of the two-arm levers to different boot widths or differently constructed ski boots.

* * * * *